US007228596B2

(12) United States Patent
Kang

(10) Patent No.: US 7,228,596 B2
(45) Date of Patent: Jun. 12, 2007

(54) HINGE ASSEMBLY FOR REFRIGERATOR DOOR

(75) Inventor: Dae-Kil Kang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 136 days.

(21) Appl. No.: 10/980,182

(22) Filed: Nov. 4, 2004

(65) Prior Publication Data

US 2005/0091794 A1 May 5, 2005

(30) Foreign Application Priority Data

Nov. 5, 2003 (KR) ..... 10-2003-0077960

(51) Int. Cl.
*E05D 11/10* (2006.01)

(52) U.S. Cl. ..... 16/330; 16/303; 16/263

(58) Field of Classification Search ..... 16/330, 16/303, 306, 386, 263, 292, 262, 273, 308, 16/289, 290, 265, 307; 4/241, 248; 220/830, 220/811, 836–838; 361/680–683
See application file for complete search history.

(56) References Cited

U.S. PATENT DOCUMENTS

| | | | | |
|---|---|---|---|---|
| 387,421 | A * | 8/1888 | Keil | 16/300 |
| 765,372 | A * | 7/1904 | Bading | 16/285 |
| 986,742 | A * | 3/1911 | Murdock | 16/263 |
| 3,710,415 | A * | 1/1973 | Wilson | 16/382 |
| 3,930,594 | A * | 1/1976 | Jungmann | 220/830 |
| 3,955,241 | A * | 5/1976 | Little | 16/298 |
| 4,583,262 | A * | 4/1986 | Werner | 16/300 |
| 5,749,624 | A * | 5/1998 | Yoshida | 297/367 |
| 5,913,351 | A * | 6/1999 | Miura | 16/340 |
| 6,256,836 | B1 * | 7/2001 | Lin et al. | 16/263 |
| 6,505,889 | B2 * | 1/2003 | Frolo et al. | 297/354.12 |
| 6,865,778 | B2 * | 3/2005 | Pan et al. | 16/342 |
| 6,948,217 | B2 * | 9/2005 | Higano et al. | 16/303 |

(Continued)

FOREIGN PATENT DOCUMENTS

FR 2771769 A1 * 6/1999

(Continued)

*Primary Examiner*—Chuck Y. Mah
(74) *Attorney, Agent, or Firm*—Birch, Stewart, Kolasch & Birch, LLP

(57) ABSTRACT

A hinge assembly for a refrigerator door improves productivity and reduces a manufacturing cost by improving a structure of a hinge assembly installed between a refrigerator main body and a door, and improves an appearance by using one hinge assembly for one door so as to coincide moving axes and thus positioning an opened door to be horizontal to the main body. To this end, the hinge assembly includes a shaft having both ends fixed to one side of a door that can be opened and closed, the door being installed at a refrigerator main body; a pair of fixed cams integrally formed at the shaft and transmitting a rotary force when the door is opened and closed; a pair of moving cams linearly reciprocating by contacting with surfaces of the fixed cams in a cam type to allow the door to remain in an opened state when the door is opened to at least a predetermined angle and to return the door to a closed state when the door is at an angle less than the predetermined angle; a housing coupled to the moving cam and fixed to the refrigerator main body; and a spring installed between the moving cams and providing an elastic force.

19 Claims, 7 Drawing Sheets

U.S. PATENT DOCUMENTS

| | | | | |
|---|---|---|---|---|
| 2003/0208881 | A1* | 11/2003 | Li | 16/330 |
| 2004/0211211 | A1* | 10/2004 | Nam et al. | 62/440 |
| 2004/0256390 | A1* | 12/2004 | Nam et al. | 220/264 |
| 2005/0108853 | A1* | 5/2005 | Lee | 16/330 |
| 2006/0002068 | A1* | 1/2006 | Kim | 361/683 |

FOREIGN PATENT DOCUMENTS

| | | | | |
|---|---|---|---|---|
| JP | 10078027 | A | * | 3/1998 |
| KR | 2003060759 | A | * | 7/2003 |
| KR | 2004073640 | A | * | 8/2004 |

* cited by examiner

HINGE ASSEMBLY FOR REFRIGERATOR DOOR

BACKGROUND OF THE INVENTION

1. Field of the Invention

The present invention relates to a refrigerator, and particularly, to a hinge assembly for a refrigerator door capable of improving an appearance and productivity by maintaining a horizontal state when a door is opened and of improving reliability of a product by smoothly supplying a lubricant.

2. Description of the Background Art

In general, there are various kinds of refrigerators according to structures and functions. Particularly, according to structures and positions of a door for opening and closing a storage space for food items, the refrigerators can be classified into as follows:

An one door type refrigerator in which a cooling chamber and a freezing chamber can be simultaneously opened and closed by using one door installed at a front of a main body; a two door type refrigerator in which the cooling chamber and the freezing chamber can be separately opened and closed by using two doors installed at the front of the main body in a longitudinal direction; a side by side type refrigerator in which the cooling chamber and the freezing chamber can be separately opened and closed by using two doors installed side by side at the front of the main body; a drawer type refrigerator in which a food storage space is slidingly drawn out of the front of the main body; a lift off type refrigerator in which a lid that can be opened and closed is installed at an upper surface of the main body; a refrigerator where the above-mentioned types are mixed; and the like.

Of those types, the drawer type and lift type are commonly employed for a refrigerator for ripening and storing Kimchi, which is called Kimchi-refrigerator. As for the Kimchi-refrigerator, when a newly made Kimchi is put in, a heater is operated to maintain a proper temperature and Kimchi is fermented at the proper temperature through successive ripening processes. Then, when the ripening processes for Kimchi are completed, components (compressor, condenser, expansion valve and evaporator) of a refrigerating cycle are operated to thereby circulate a refrigerant. In such a manner, the Kimchi refrigerator is maintained at a low temperature so as to be prevented from going bad.

FIG. 1 shows a general lift off type refrigerator.

As shown, in the general lift off type refrigerator, an inner case 13 is installed inside a main body 10 having an opened upper side, forming a freezing chamber (F) and/or a cooling chamber (C) for storing food items therein. A separate heater (not shown) and components of a refrigerating cycle are installed at a space between the main body 100 and the inner case 13 to thereby maintain the freezing chamber (F) and/or the cooling chamber (C) at a proper temperature.

A top cover 15 provided with two entrance/exit parts through which food items are brought in or taken out is installed at an upper surface of the main body 10, and two doors 20 that can be opened and closed are installed side by side to cover the entrance/exit parts of the top cover 15. Here, the door 20 that can be opened and closed has a rear end which is fixed to the main body 10 and the top cover 15 by a hinge assembly 30. The hinge assembly 30 operates to close the door 20 when the door 20 is at an angle less than a set angle, and stops to allow the door 20 to remain in an opened state when the door is opened to at least a set angle.

As shown in FIG. 2, hinge fixing portions 25 protrude rearward from both sides of a rear end of the door, and hinge fixing grooves 26 are formed on surfaces facing each other, of the hinge fixing portions 25, respectively. One end of each hinge assembly 30 is inserted in the hinge fixing groove 26, and then the hinge assembly 30 is screw-coupled to the main body through a coupling hole 37. Thereafter, a separate bracket (not shown) for decoration is installed to cover the hinge assembly 30 and the hinge fixing portion 25.

Particularly, as shown in FIG. 3, the hinge assembly 30 includes a shaft 31 having one end inserted in the hinge fixing groove 26, wherein a fixed cam 32 is integrally formed at the shaft 31; a moving cam 33 penetratingly installed at the shaft 31 and contacting with the fixed cam 32 formed at the shaft 31 in a cam type; a spring 35 penetratingly installed at the shaft 31, for elastically supporting the moving cam 33; and a housing 36 installed to enclose the shaft 31, the fixed cam 32, the moving cam 33 and the spring 35. A washer 34 is provided between the moving cam 33 and the spring 35, so that the spring 35 can be supported at the moving cam 33 through the washer 34.

Here, the shaft 31 is installed with its one end being inserted in the hinge fixing groove 26 to thereby rotate together with the door 20.

As for the moving cam 33, its outer circumferential surface is formed indented as a teeth shape, and stopping protrusions (not shown) are formed at the outer circumferential surface so as to be engaged with an inner circumferential surface of the housing 30.

The housing 36 is connected to a refrigerator main body. Namely, the moving cam 33 and the housing 36 are connected to each other, and the housing 36 is coupled to the refrigerator main body. For this reason, the moving cam 33 can move in an axial direction but cannot rotate.

At this time, the fixed cam 32 and the moving cam 33 make a relative motion by contacting with lines of each other in a cam type. Therefore, when the door 20 is opened or closed, a rotary motion of the shaft 31 and the fixed cam 32 is changed into a linearly reciprocating motion at the moving cam 33 by an interaction with the spring 35, to thereby control an opening/closing operation of the door 20. An extent to which the door is opened/closed can be controlled with a compressive force of the spring 35 and a gradient of curved surface of the fixed cam 32 and the moving cam 33.

However, the hinge structure for the conventional lift off type refrigerator door as described above is disadvantageous in that because two hinge assemblies are respectively installed at both sides of the door, it is difficult to coincide moving axes of the two hinge assembly with each other. If the moving axes of the hinge assemblies do not coincide with each other, both sides of the door are not horizontal but inclined when viewed from the front, thereby degrading the appearance.

In addition, in the conventional hinge structure for a door, a lubricant such as grease or the like is used so that a contact between the fixed cam and the moving cam in a cam type is smoothly made. Here, if the lubricant is solidified or leaked due to frictional heat or the like in operation, repetitive friction and abrasion undesirably occur between the fixed cam and the moving cam, and degradation of hinge operation performance such as noise generation occurs.

Also, because one end of the spring is installed and supported at a closed portion of the housing, the spring is compressed in operation, being supported at the housing. Accordingly, a residual stress is undesirably generated because of the accumulated fatigue of the spring, thereby weakening the strength.

SUMMARY OF THE INVENTION

Therefore, an object of the present invention is to provide a hinge assembly for a refrigerator door capable of improving productivity and reducing a manufacturing cost by improving a structure of a hinge assembly installed between a refrigerator main body and a door and of improving an appearance by using one hinge assembly for one door so as to coincide moving axes and thus positioning an opened door to be horizontal to the main body.

Another object of the present invention is to provide a hinge structure for a refrigerator door capable of improving reliability of a product by smoothly supplying a lubricant.

To achieve these and other advantages and in accordance with the purpose of the present invention, as embodied and broadly described herein, there is provided a hinge assembly for a refrigerator door comprising: a shaft having both ends fixed to one side of a door that can be opened and closed, the door being installed at a refrigerator main body; a pair of fixed cams integrally formed at the shaft and transmitting a rotary force when the door is opened and closed; a pair of moving cams linearly reciprocating by contacting with surfaces of the fixed cams in a cam type to allow the door to remain in an opened state when the door is opened to at least a predetermined angle and to return the door to a closed state when the door is at an angle less than the predetermined angle; a housing coupled to the moving cam and fixed to the refrigerator main body; and a spring installed between the moving cams and providing an elastic force.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings. A plurality of embodiments of a hinge structure for a refrigerator door in accordance with the present invention may exist, and the most preferred embodiment will now be described.

Figure 1:
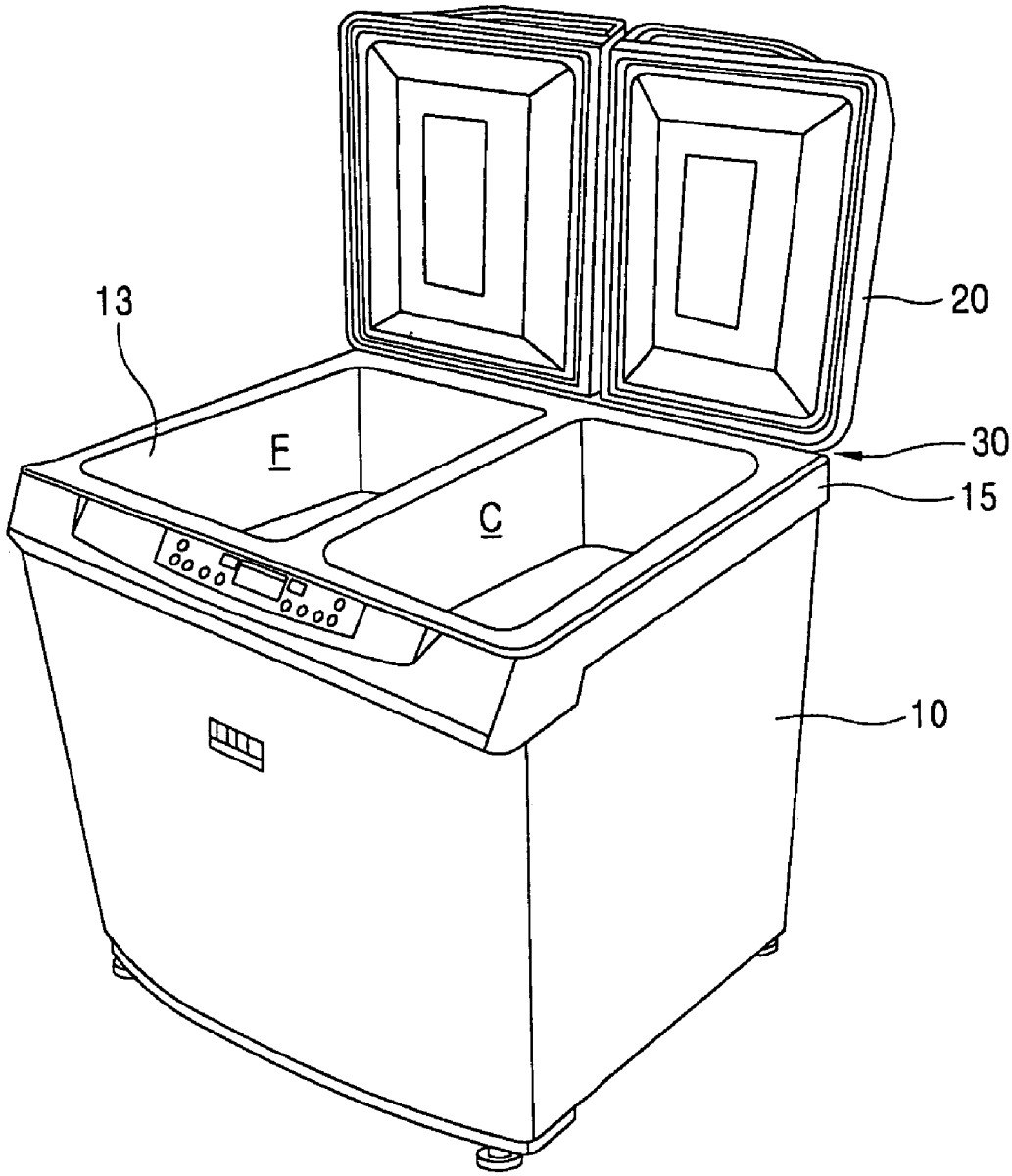
FIG. 1 CONVENTIONAL ART
FIG. 1 is a perspective view of a general lift off type refrigerator.
Figure 2:
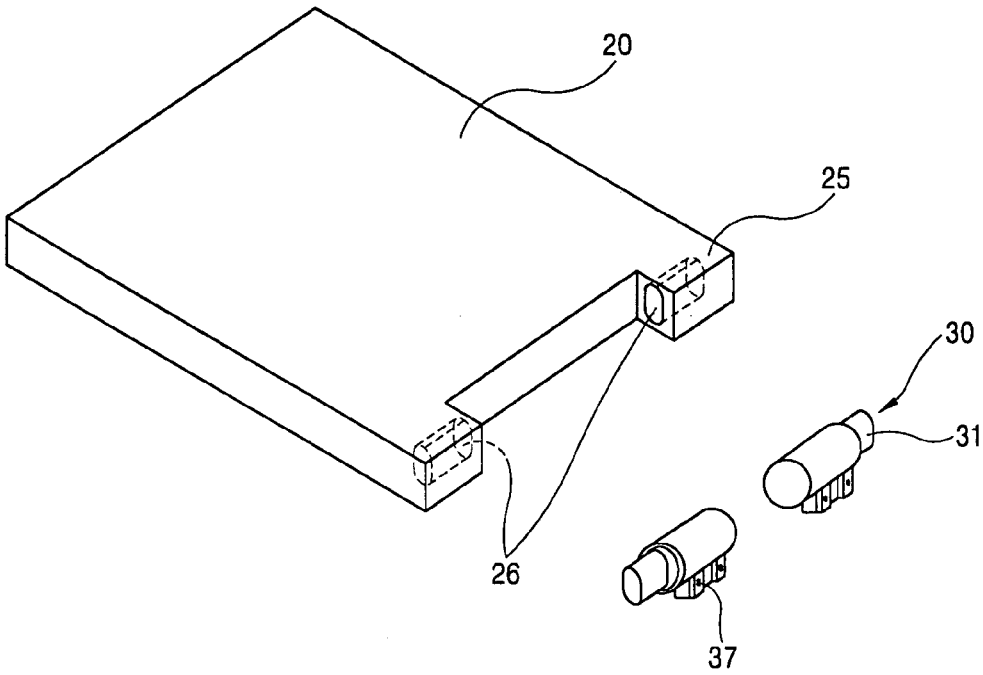
FIG. 2 CONVENTIONAL ART
FIG. 2 is a perspective view showing an assembling structure of a conventional hinge assembly.
Figure 3:
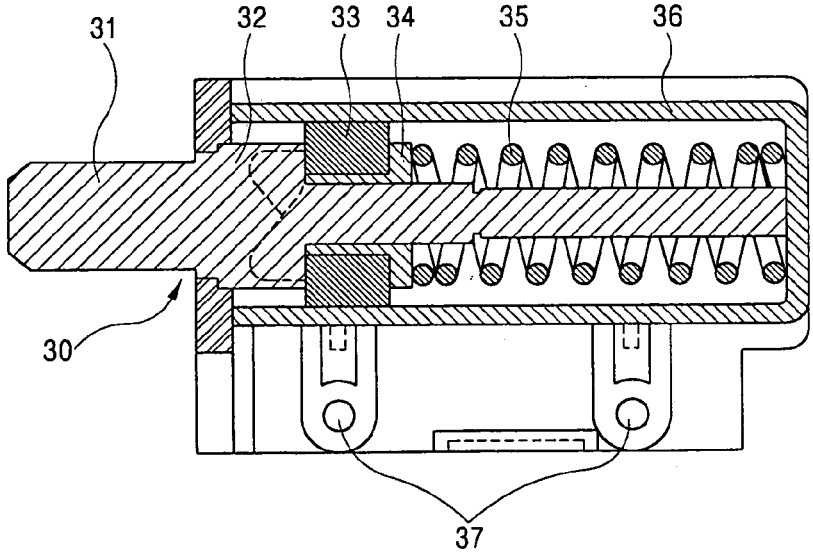
FIG. 3 CONVENTIONAL ART
FIG. 3 is a sectional view showing the conventional hinge assembly.
Figure 4:
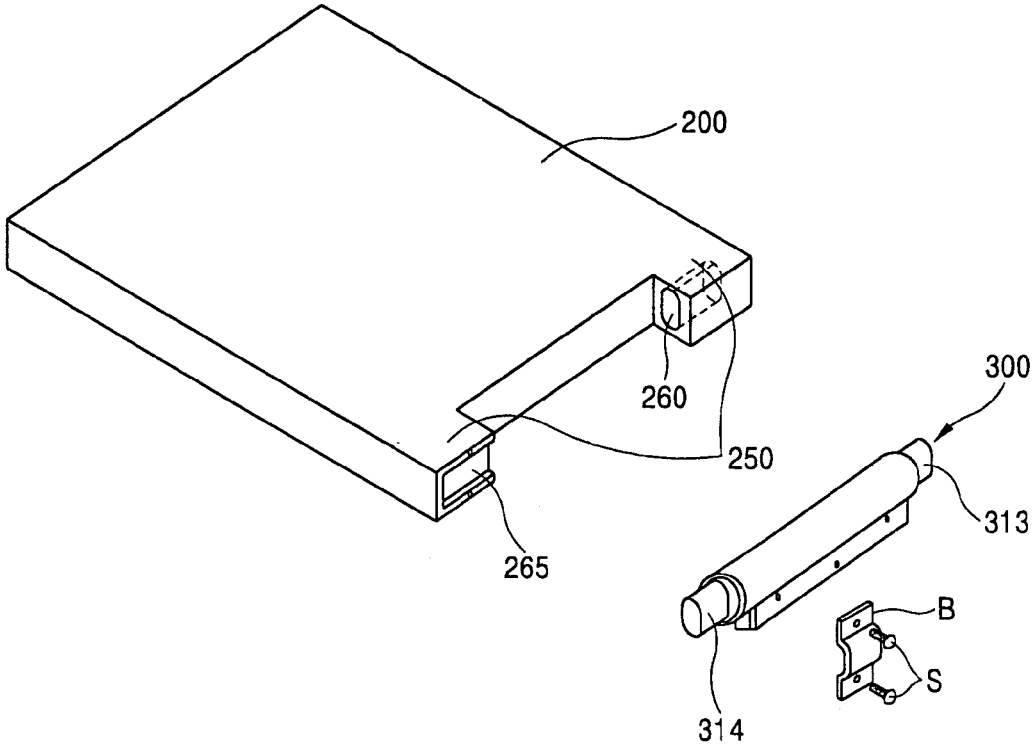
FIG. 4 is an exploded perspective view showing a hinge assembly for a refrigerator door in accordance with a first embodiment of the present invention.
Figure 5:
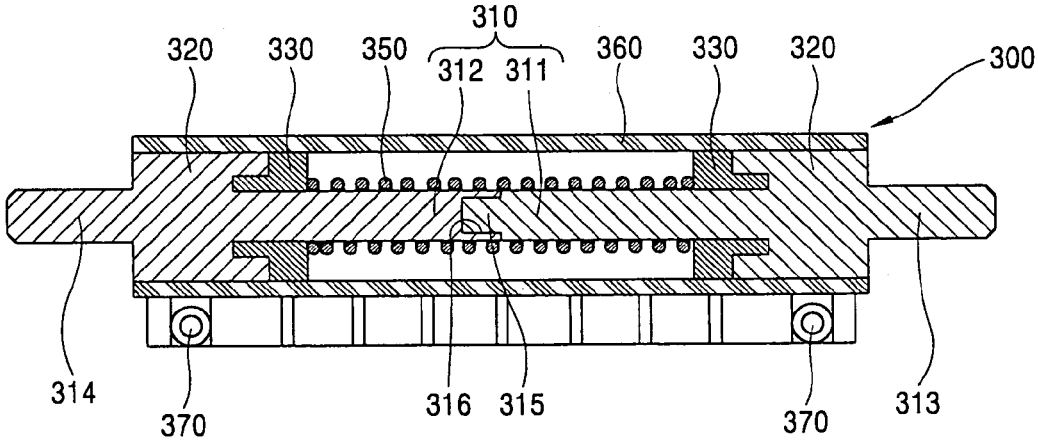
FIG. 5 is a sectional view showing a hinge assembly for a refrigerator door in accordance with the first embodiment of the present invention.

FIG. 4 is an exploded perspective view showing a hinge assembly for a refrigerator door in accordance with a first embodiment of the present invention, and FIG. 5 is a sectional view showing the hinge assembly in accordance with the first embodiment of the present invention.

As shown, the hinge assembly 300 for a refrigerator door in accordance with the present invention includes: a shaft 310 having both ends fixed to one side of a door 200 which can be opened and closed, the door being installed at one side of the refrigerator; a pair of fixed cams 320 integrally formed at the shaft 310 and transmitting a rotary force when the door 200 is opened and closed; a pair of moving cams 330 linearly reciprocating by contacting with surfaces of fixed cams 320 in a cam type to allow the door 200 to remain in an opened state when the door is opened to at least a certain angle and to return the door to a closed state when the door 200 is at an angle less than the certain angle; a housing 360 coupled to the moving cam 330 and fixed to the refrigerator main body; and a spring 350 installed between the moving cams 330 and providing an elastic force.

The door 200 has hinge fixing portions 250 protruding rearward from both sides of a rear end. A hinge fixing groove 260 in which one end of the hinge assembly 300 is inserted is formed at a surface of one hinge fixing portion, wherein the surface faces the other hinge fixing portion 250. A hinge receiving groove 265 in which the other end of the hinge assembly 300 is received is formed at a rear surface of the other hinge fixing portion 250.

One end of the shaft 310 is fixed to one hinge fixing portion 250 by being inserted in the hinge fixing groove 260 in an axial direction, and then the other end is received in the hinge receiving groove 265 and fixed to the other hinge fixing portion 250 by a separate fixing bracket (B). A lower end of the fixing bracket (B) is screw(S)-fixed to the main body.

A coupling hole 370 is formed at a lower end of the housing 360 so that the housing 360 can be screw-fixed to the main body.

Figure 6:
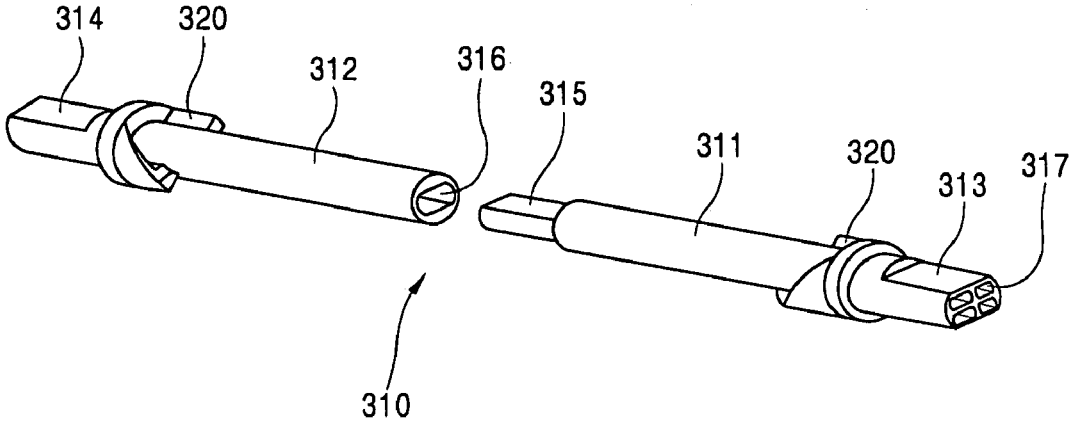
FIG. 6 is an exploded perspective view showing a shaft in accordance with the first embodiment of the present invention.

The shaft 310 is constructed such that first and second shaft members 311 and 312 are assembled to each other in an axial direction, and this is shown in FIG. 6 in detail.

As for the first shaft member 311, a first fixed portion 313 which is insertedly fixed to the hinge fixing groove 260 is formed at its one end, and an assembling protrusion 315 having a smaller diameter than that of the one end is formed at its other end.

Preferably, the first fixed portion 313 and the assembling protrusion 315 are formed as a many-sided shape so that a slip does not occur during a coupling operation.

In addition, preferably, a position determining groove 317 is formed at a front end of the first fixed portion 313, and a position determining protrusion (not shown) is formed at the hinge fixing groove 260, so that the first fixed portion 313 can be assembled to the hinge fixing groove 260 in an accurate assembling direction.

As for the second shaft member 312, an assembling groove 316 to which the assembling protrusion 315 is insertedly coupled is formed at its one end, and a second fixed portion 314 received in the hinge receiving groove 265 is formed at its other end.

The fixed cams 320 may be integrally formed at the first and second shaft members 311 and 312, respectively, or may be separately manufactured and then fixed to be assembled.

Cam surfaces formed at the fixed cams 320 are positioned inwardly in a facing manner.

Figure 7:
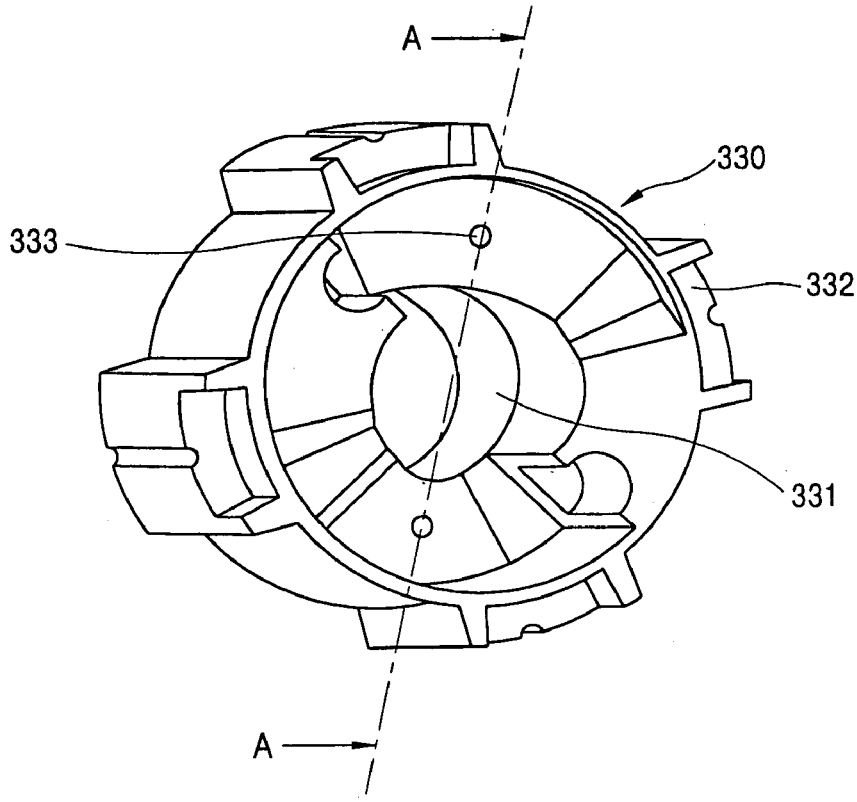
FIG. 7 is a perspective view showing a moving cam in accordance with the first embodiment of the present invention.

FIG. 7 is a perspective view showing a moving cam in accordance with the first embodiment of the present invention. As shown, a hole 331 is formed at the center of each moving cam 33, so that the first and second shaft members 311 and 312 penetrate therethrough. A cam surface is formed at one surface of the moving cam 330 to contact with a spiral cam surface of the fixed cam 320, and the spring 350 is installed and supported at the other surface of the moving cam 330.

The cam surfaces of the fixed cam 320 and the moving cam 330 are formed to contact with each other to reduce friction and abrasion.

Reference number 322 in the drawing is a slip preventing protrusion to be described later.

Figure 8:
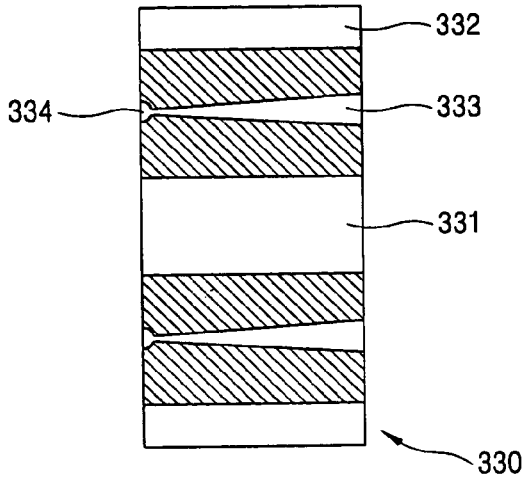
FIG. 8 is a sectional view taken along line A—A of FIG. 7.

FIG. 8 is a sectional view taken along line A—A of FIG. 7.

As shown, the moving cam 330 includes at least one lubricant nozzle penetrating in an axial direction, so that a lubricant such as grease or the like can be automatically supplied toward the cam surface.

The lubricant nozzle 33 is formed as a conical shape with a diameter decreasing from a front end of the moving cam 330 contacting with the fixed cam 320 toward its rear end. Accordingly, a small amount of lubricant stored in the lubricant nozzle 333 is automatically applied to the contact surface by a pressure difference generated as the moving cam 330 contacts with a surface of the fixed cam 320.

At this time, a lubricant storage groove 334 with an increased diameter is formed at a place corresponding to an apex of the conical shape of the lubricant nozzle 333 so as to temporarily store the lubricant stored in the lubricant nozzle 333 even if the moving cam 330 moves in a direction that the spring 350 is compressed by a surface contact between the fixed cam 320 and the moving cam 330.

Preferably, the lubricant storage groove 334 is formed as a hemispherical shape.

Figure 9:
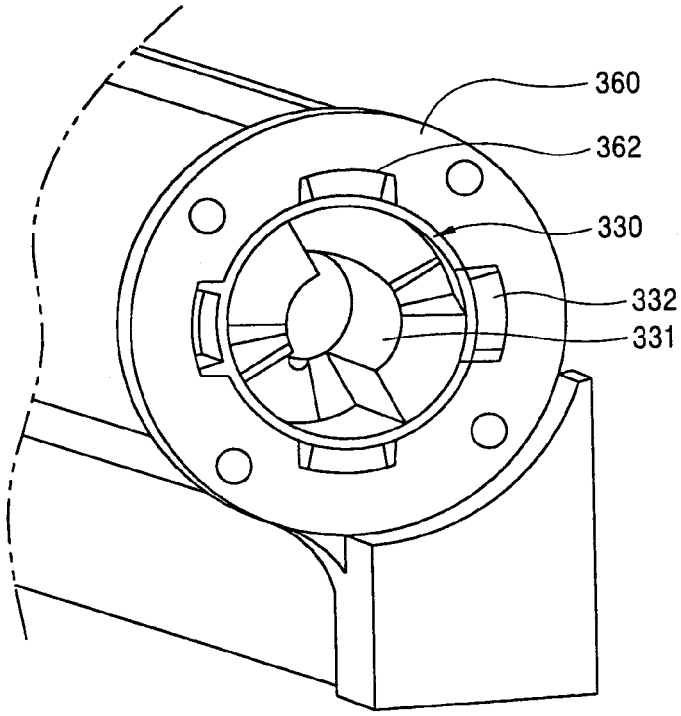
FIG. 9 is a perspective view showing an assembling structure of a moving cam and a housing in accordance with the first embodiment of the present invention.

FIG. 9 is a perspective view showing an assembling structure of the moving cam and the housing in accordance with the first embodiment of the present invention.

As shown, a plurality of slip preventing protrusions 332 with at least a predetermined length are formed at an outer circumferential surface of each moving cam 330.

The slip preventing protrusions 332 are coupled to a plurality of slip preventing grooves 362 formed at an inner circumferential surface of the housing 360, thereby restricting rotation. Namely, because the housing 360 is coupled to the refrigerator main body, the moving cam 330 can move in an axial direction but cannot rotate. At this time, the slip preventing protrusions 332 are formed at an outer circumferential surface of the moving cam 330 at intervals of 90 degrees. To be sure, the slip preventing grooves 362 are formed at intervals of 90 degrees, corresponding to the slip preventing protrusions 332. Such a structure can reduce friction and abrasion because when the moving cam 330 transmits a rotary moment to the housing 360 by contacting with a surface of the fixed cam 320 in opening or closing of the door 200, the moment is dispersed. In addition, because a rotary moment of the moving cam 330 works with a contact surface of the housing 360 at an angle of 90, a rotation clearance due to a slip between two components can be prevented.

The housing 360 is formed as a cylindrical shape, and has the slip preventing groove 362 at an inner circumferential surface, and a coupling hole 370 is formed at its lower end so that the housing 360 can be screw-fixed to the main body 360.

A compression coil spring is used as the spring 350, and both ends of the spring 350 are supported by the moving cams.

Assembling processes for a hinge assembly having such a structure will now be described. First, the moving cams are inserted upon the first and second shaft members with their cam surfaces contacting with cam surfaces of the fixed cams, respectively. Thereafter, in a state that the spring is supported between the moving cams, an assembling protrusion of the first shaft member is assembled to an assembling groove of the second shaft member by being inserted thereto. Then, the housing is assembled to encompass the first and second shaft members, the fixed cams, the moving cams and the spring.

After the hinge assembly is assembled in such a manner, a first fixed portion of the first shaft member is insertedly fixed to a hinge fixing groove formed at one hinge mounting portion of the door, and a second fixed portion of the second shaft member is received in a hinge receiving groove formed at the other hinge mounting portion of the door and then fixed by a separate fixing bracket and a screw. Then, a coupling hole of the housing is fixed to the main body by a screw. Thereafter, a separate bracket (not shown) for decoration may be installed to cover the hinge assembly for the better appearance.

Operations and effect of the present invention will now be described.

When a user opens a door, the shaft connected to the door rotates with the fixed cam formed at the shaft. The moving cam supported by the spring contacts with a surface of the fixed cam and receives a moment of the fixed cam. At this time, the moving cam is coupled to the housing, and the housing is screw-coupled to a main body. For this reason, a rotary motion of the moving cam is restricted, and only a linear motion in an axial direction can be made. When the door is at an angle less than a certain angle, the fixed cam and the moving cam slide on each other's cam surfaces to thereby close the door because a compressive force of the spring continuously pushes the moving cam toward the fixed cam. When opened to at least the certain angle, the door is allowed to remain in an opened state. This is because the fixed cam and the moving cam are designed not to slide but to be caught by each other's cam surfaces in case that the door is opened to at least the certain angle.

At this time, because one hinge assembly is used for one door so as to make moving axes coincide, the door is stopped at a correct position without being inclined, thereby not only improving an appearance but also reducing the number of components. Accordingly, productivity can be improved and a manufacturing cost can be reduced.

Also, in the present invention, because a lubricant nozzle for automatically supplying a lubricant between the moving cam and the fixed cam is formed at the moving cam, the lubricant is continuously supplied, so that a smooth relative motion between the moving cam and the fixed cam can be made and friction, abrasion and noise can be reduced.

In addition, in the present invention, because the housing restricts only a rotary motion of the moving cam and does not directly receive a compressive force of the spring, the strength can be secured even if the door is repetitively opened. Accordingly, reliability of a product can be improved.

Figure 10:
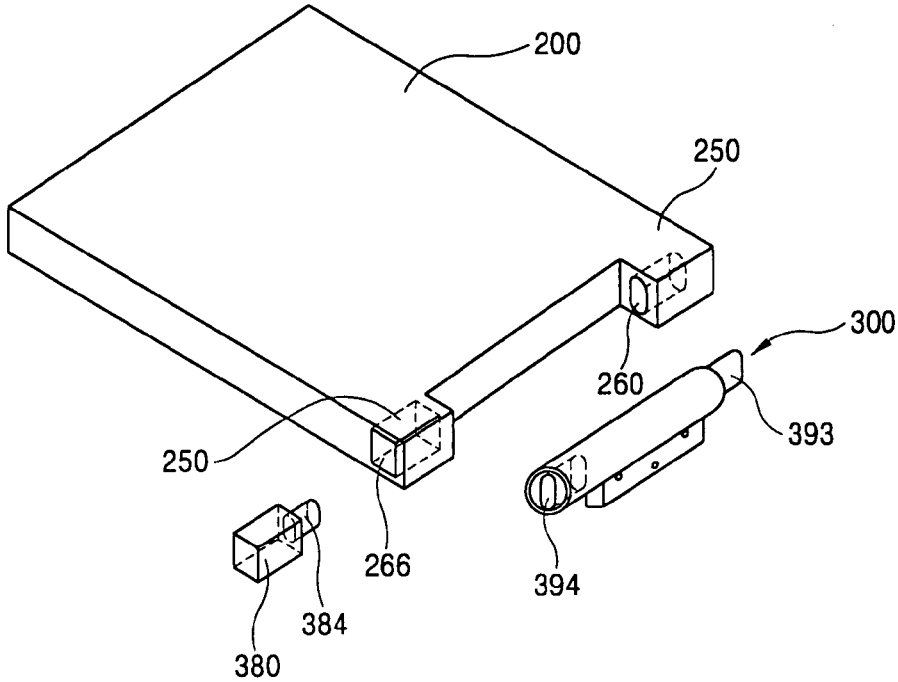
FIG. 10 is an exploded perspective view showing a hinge assembly in accordance with a second embodiment of the present invention.
Figure 11:
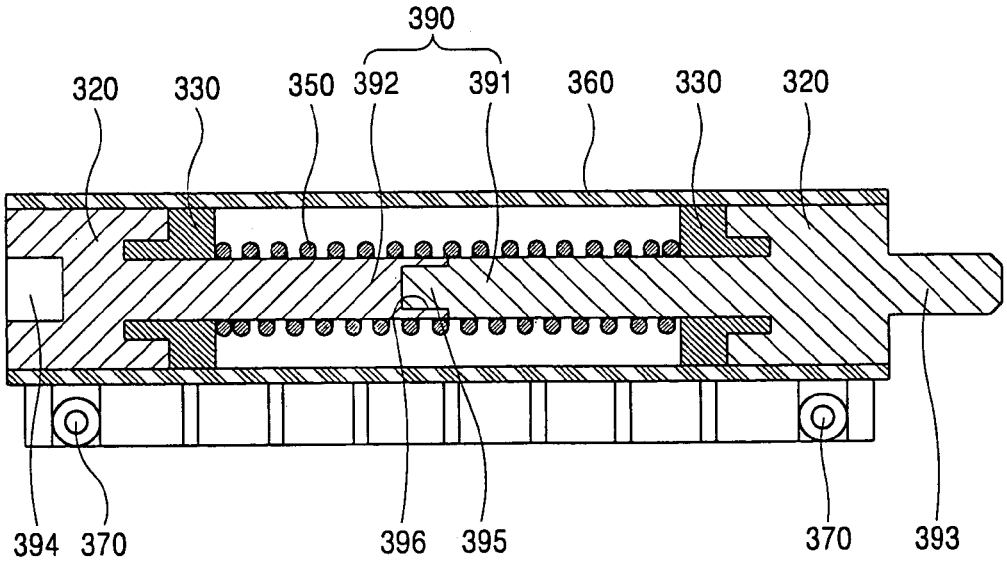
FIG. 11 is a sectional view showing a hinge assembly in accordance with the second embodiment of the present invention.

FIG. 10 is an exploded perspective view showing a hinge assembly in accordance with the second embodiment of the present invention and FIG. 11 is a sectional view showing a hinge assembly in accordance with the second embodiment of the present invention.

As shown, the hinge assembly in accordance with the second embodiment of the present invention includes a pair of fixed cams 320 integrally formed at the shaft 390 and transmitting a rotary force when the door 200 is opened and closed; and a pair of moving cams 330 linearly reciprocating by contacting with surfaces of the fixed cams 320 in a cam type to allow the door to remain in an opened state when the door is opened to at least a certain angle and to return the door to a closed state when the door is at an angle less than the certain angle, and the door 200 has hinge fixing portions 250 protruding rearward from both sides of a rear end. Those structures are the same as those of the first embodiment. Here, a hinge fixing groove 260 to which one end of the hinge assembly 300 is inserted is formed at a surface of one hinge fixing portion 250, wherein the surface faces the other hinge portion. And a hinge fixing hole 266 is penetratingly formed at the other hinge fixing portion, so that the other end of the hinge assembly 300 is fixed by a separate fixing bush 380.

The fixing bush 380 has at one side an assembling protrusion 384 protruding with a smaller diameter, and when the fixing bush 380 is inserted in the hinge fixing hole 266, the assembling protrusion 384 of the fixing bush 380 is inserted in one end of the hinge assembly 300 to be fixed.

One end of the hinge assembly 300 is inserted in the hinge fixing groove 260 in a axial direction to thereby be fixed to one hinge fixing portion 250. And the other end is positioned at the hinge fixing hole 266 of the door 200, and, in such a sate, a separate fixing bush 380 is inserted in the hinge fixing hole 266 and the hinge assembly 300 in a direction opposite to a direction that the other end is positioned, to thereby be assembled and fixed thereto.

As shown in FIG. 11, specifically, the/hinge assembly includes a shaft, a pair of fixed cams, a pair of moving cams, a spring and a housing, which have the same structure and operation as those of components employed in the first embodiment.

Figure 12:
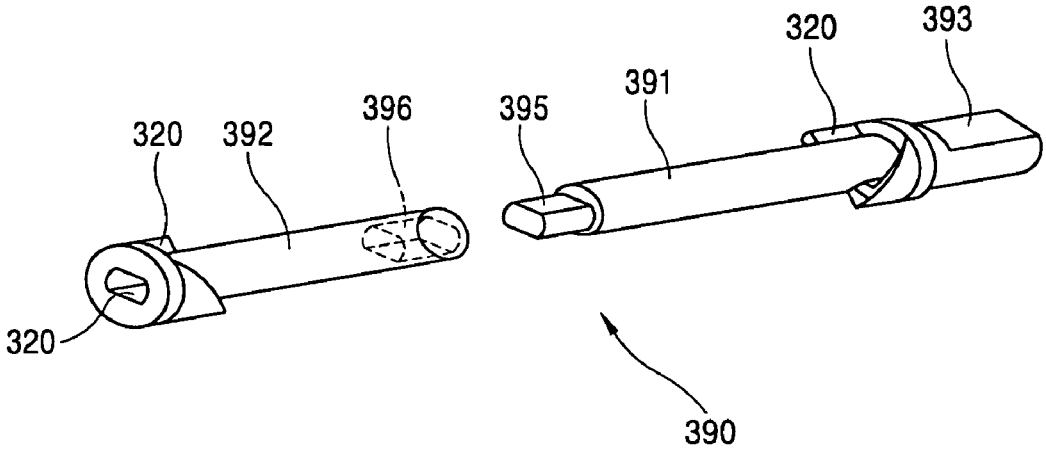
FIG. 12 is an exploded perspective view showing a shaft in accordance with the second embodiment of the present invention.

FIG. 12 is an exploded perspective view showing a shaft in accordance with the second embodiment of the present invention. The first and second shaft members 391 and 392 are constructed to be assembled to each other in an axial direction. The construction of the second embodiment is the same as that of the first embodiment except that a fixing groove 394 is formed at one end of the shaft so that the assembling protrusion 384 of the fixing bush 380 can be inserted therein. Similarly, an assembling type of the hinge assembly of the second embodiment is the same as that of the first embodiment except that the fixing bush 380 is inserted in the hinge fixing hole 266 and the fixing groove 394 in a state that the fixing groove 394 of the second shaft member 392 is positioned corresponding to the hinge fixing hole 266 of the door 200.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A hinge assembly for connecting a door to a main body, the hinge assembly comprising:

a shaft having both ends fixable to one side of a door;

a pair of fixed cams integrally formed at the shaft and transmitting a rotary force when the shaft is rotated, wherein, with the shaft fixed to the door, the shaft can be rotated by the door;

a pair of moving cams linearly reciprocating by contacting with surfaces of the fixed cams, wherein, with the shaft fixed to the door, the fixed cams allow the door to remain in an opened state when the door is opened to at least a predetermined angle and to return the door to a closed state when the door is at an angle less than the predetermined angle;

a housing coupled to the moving cams and fixable to a main body; and a spring installed between the moving cams and providing an elastic force.

2. The hinge assembly of claim 1, wherein the shaft comprises:

a first shaft member having at one end a first fixed portion having a cylindrical shape and fixable to the door, and having at the other end an assembling protrusion with a diameter smaller than that of the one end; and a second shaft member having at one end an assembling groove having a cylindrical shape and inserted upon the assembling protrusion of the first shaft member, and having at the other end a second fixed portion fixable to the door.

3. The hinge assembly of claim 2, wherein the first fixed portion is formed as a many-sided shape so that a slip does not occur in a coupling operation.

4. The hinge assembly of claim 2, wherein the assembling protrusion is formed as a many-sided shape so that a slip does not occur in a coupling operation.

5. The hinge assembly of claim 2, wherein a pair of hinge fixing portions are provided, wherein a hinge fixing groove in which the first fixed portion of the first shaft member is inserted in an axial direction is formed at one hinge fixing portion, a hinge receiving groove in which the second fixed portion of the second shaft member is received is formed at the other hinge fixing portion, and the second fixed portion of the second shaft member is fixed to the hinge receiving groove by a separate fixing bracket.

6. The hinge assembly of claim 1, wherein the shaft comprises:

a first shaft member having at one end a first fixed portion having a cylindrical shape and fixable to the door, and having at the other end an assembling protrusion with a diameter smaller than that of the one end; and a second shaft member having at one end an assembling groove having a cylindrical shape and inserted upon the assembling protrusion of the first shaft member, and having at the other end a fixing groove fixable to the door.

7. The hinge assembly of claim 6, wherein a pair of hinge fixing portions are provided, wherein a hinge fixing groove to which the first fixed portion of the first shaft member is insertedly fixed is formed at one hinge fixing portion, a hinge fixing hole in which a fixing bush is inserted in an axial direction is formed at the other hinge fixing portion, and the fixing groove of the second shaft member is caught by the fixing bush inserted in the hinge fixing hole to thereby be fixed.

8. The hinge assembly of claim 6, wherein the first fixed portion is formed as a many-sided shape so that a slip does not occur in a coupling operation.

9. The hinge assembly of claim 6, wherein the assembling protrusion is formed as a many-sided shape so that a slip does not occur in a coupling operation.

10. The hinge assembly of claim 1, wherein the moving cain comprises one or more lubricant nozzle penetratingly formed in an axial direction, so that a lubricant is automatically supplied to a contact surface with the fixed cam.

11. The hinge assembly of claim 10, wherein the lubricant nozzle has a conical shape having a diameter decreasing from a front end of the moving cam contacting with the fixed cam toward a rear end.

12. The hinge assembly of claim 11, wherein the lubricant nozzle includes a lubricant storage groove having an increasing diameter at a place corresponding to an apex of the conical shape.

13. The hinge assembly of claim 12, wherein the lubricant storage groove has a hemispherical shape.

14. The hinge assembly of claim 1, wherein a plurality of slip preventing protrusions protruding at a predetermined length or longer are formed at an outer circumference of the moving cam, and a plurality of slip preventing grooves are formed at an inner circumference of the housing, wherein the slip preventing protrusions are inserted in the slip preventing grooves.

15. The hinge assembly of claim 14, wherein the plurality of slip preventing protrusions and the plurality of slip preventing grooves are formed at intervals of 90 degrees.

16. The hinge assembly of claim 1, wherein the housing is formed as a cylindrical shape to enclose the fixed cam, the moving cam and the spring, and has a coupling hole at its lower end, wherein the coupling hole is fixable to the main body.

17. A cabinet comprising:

a main body;

a door;

a hinge assembly pivotally coupling the door to the main body, the hinge assembly including:

a shaft having both ends fixed to one side of the door;

a pair of fixed cams integrally formed at the shaft and transmitting a rotary force when the shaft is rotated by the door being opened and closed;

a pair of moving cams linearly reciprocating by contacting with surfaces of the fixed cams to allow the door to remain in an opened state when the door is opened to at least a predetermined angle and to return the door to a closed state when the door is at an angle less than the predetermined angle;

a housing coupled to the moving cam and fixed to the main body; and a spring installed between the moving cams and providing an elastic force.

18. The cabinet according to claim 17, wherein the cabinet is a refrigerator.

19. The cabinet according to claim 17, wherein the cabinet is a kimchi refrigerator.

* * * * *